United States Patent [19]

Ramun

[11] Patent Number: 4,799,852

[45] Date of Patent: Jan. 24, 1989

[54] SELF-CONTAINED DEMOLITION BUCKET ATTACHMENT

[75] Inventor: John R. Ramun, Youngstown, Ohio

[73] Assignee: Allied Gator, Inc., Youngstown, Ohio

[21] Appl. No.: 24,969

[22] Filed: Mar. 12, 1987

[51] Int. Cl.[4] ..... B65F 9/18

[52] U.S. Cl. ..... 414/724; 37/117.5

[58] Field of Search ..... 414/704, 724, 740; 37/117.5

[56] References Cited

U.S. PATENT DOCUMENTS

| | | | |
|---|---|---|---|
| 2,577,977 | 12/1957 | Nelson | 414/724 |
| 3,065,557 | 11/1962 | Pewthers | 414/724 X |
| 3,148,787 | 9/1964 | Clark et al. | 414/740 |
| 3,477,602 | 11/1969 | Peterson | 414/704 |
| 3,567,050 | 3/1971 | Pasquazzi et al. | 414/740 |
| 3,595,416 | 7/1971 | Perrotti | 414/724 X |
| 3,700,131 | 10/1972 | Westendorf | 414/704 |
| 3,842,999 | 10/1974 | Asbury | 414/724 |
| 4,283,866 | 8/1981 | Ogawa | 37/117.5 |
| 4,285,628 | 8/1981 | Jankowski | 414/912 X |
| 4,382,625 | 5/1983 | Labounty | 414/740 X |
| 4,519,739 | 5/1985 | Risch | 414/704 X |

OTHER PUBLICATIONS

Peterson 977L Demolition Bucket Specification Brochure, 2 pages, no date.

*Primary Examiner*—Robert J. Spar
*Assistant Examiner*—Donald W. Underwood
*Attorney, Agent, or Firm*—Harpman & Harpman

[57] ABSTRACT

An attachment for a loading bucket of a construction vehicle enables it to be used as a demolition device as well as a loading bucket. The attachment comprises a pair of elongated reinforcing members secured to the body of the bucket to form a rigid cross-sectionally square member on which spaced upstanding apertured plates are mounted so as to engage several surfaces of the reinforcing members. A demolition member consisting of a pair of jaws with a structural web therebetween is removably engaged on said upstanding apertured plates for pivotal movement between a first position in front of said loading bucket and a second position above said loading bucket. Piston and cylinder assemblies in said jaws engage the same and the upstanding apertured plates for moving said demolition member.

5 Claims, 4 Drawing Sheets

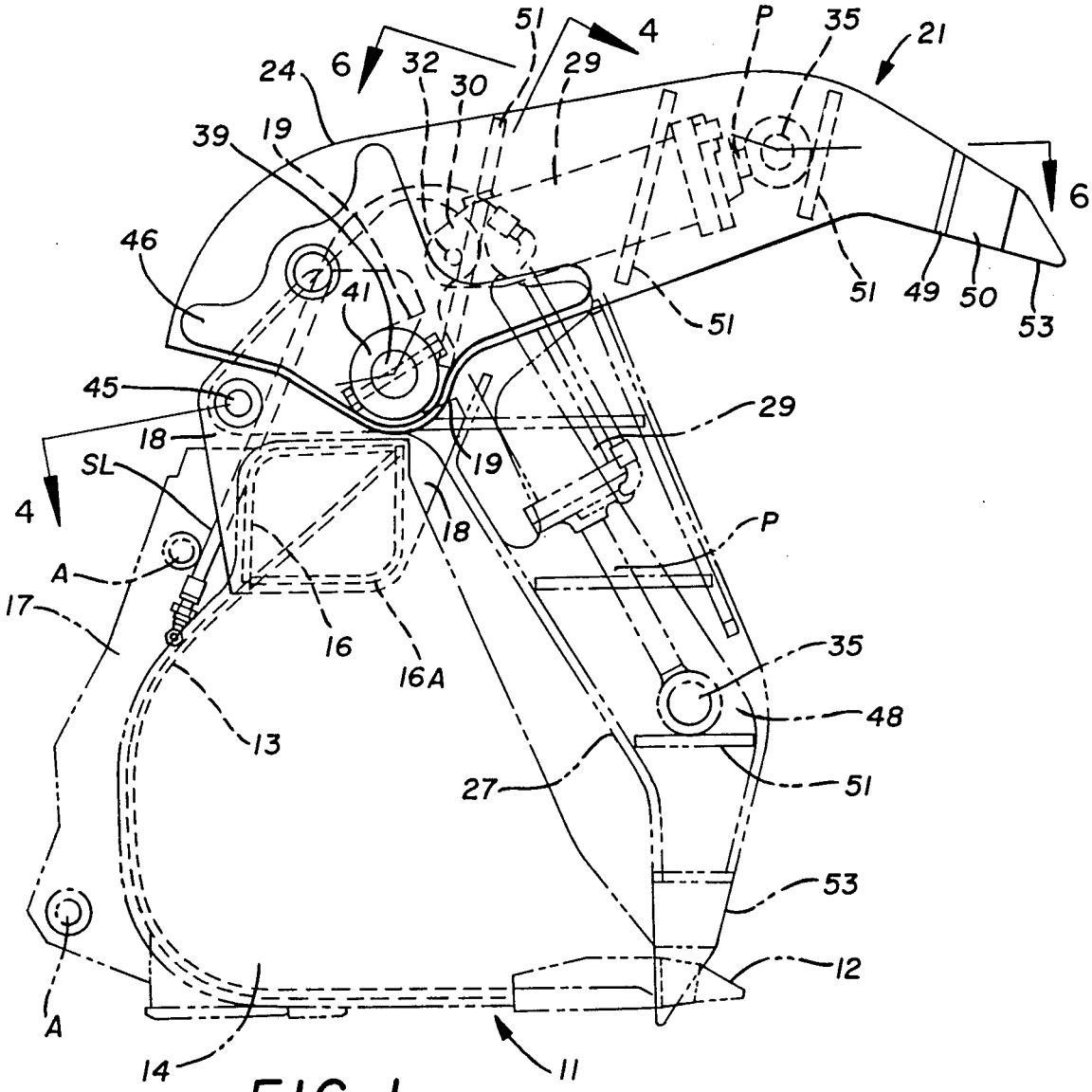
FIG. 1
FIG. 6
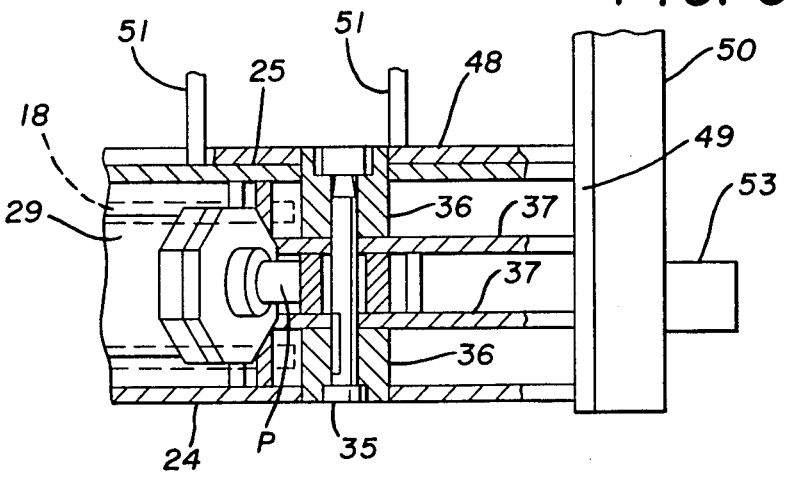

SELF-CONTAINED DEMOLITION BUCKET ATTACHMENT

BACKGROUND OF THE INVENTION

1. Technical Field:

This invention relates to demolition buckets that have hydraulically powered movable jaws that can load, grab, and demolish structures and associated material normally present in demolition work.

2. Description of Prior Art:

Prior Art devices of this type are characterized by demolition shovles or buckets that are mounted on bulldozers or tractors, see for example U.S. Pat. No. 3,567,050, Pat. No. 3,148,787, Pat. No. 3,842,999 and a demolition bucket manufactured by Peterson as seen on enclosed catalog sheet.

In U.S. Pat. No. 3,567,050 a shovel is disclosed comprising upper and lower jaws pivoted to one another with a pair of power cylinders secured to the lower jaw for moving the upper jaw.

Pat. No. 3,148,787 shows a loader bucket having a clamp pivoted to the bucket portion with power cylinders on the bucket driving the clamp.

U.S. Pat. No. 3,842,999 discloses a demolition bucket having a clamping portion pivoted to the bucket. Piston and cylinder assemblies are provided for moving the clamping portion.

The Peterson demolition bucket shown in the enclosed catalog sheet has a bucket with a pivoted cover portion with offset arms on the bucket for moving the cover portion with power cylinders.

SUMMARY OF THE INVENTION

A demolition bucket attachment that converts standard loading buckets into demolition buckets comprises a pair of movable jaws interconnected by a structural web. The attachment includes reinforcing members and mounting plates for the loading bucket arranged to removably secure the movable jaws and interconnecting structural webs thereto. Piston and cylinder assemblies are contained within each movable jaw forming a self-contained movable demolition member that can easily be moved from one bucket to another when needed.

DESCRIPTION OF THE DRAWINGS

FIG. 1 is a side plan view of the bucket attachment on a loading bucket;

FIG. 6 is an enlarged section of a portion of one of the jaws of the bucket attachment on lines 6—6 of FIG. 1.

DESCRIPTION OF THE PREFERRED EMBODIMENT

Figure 2:
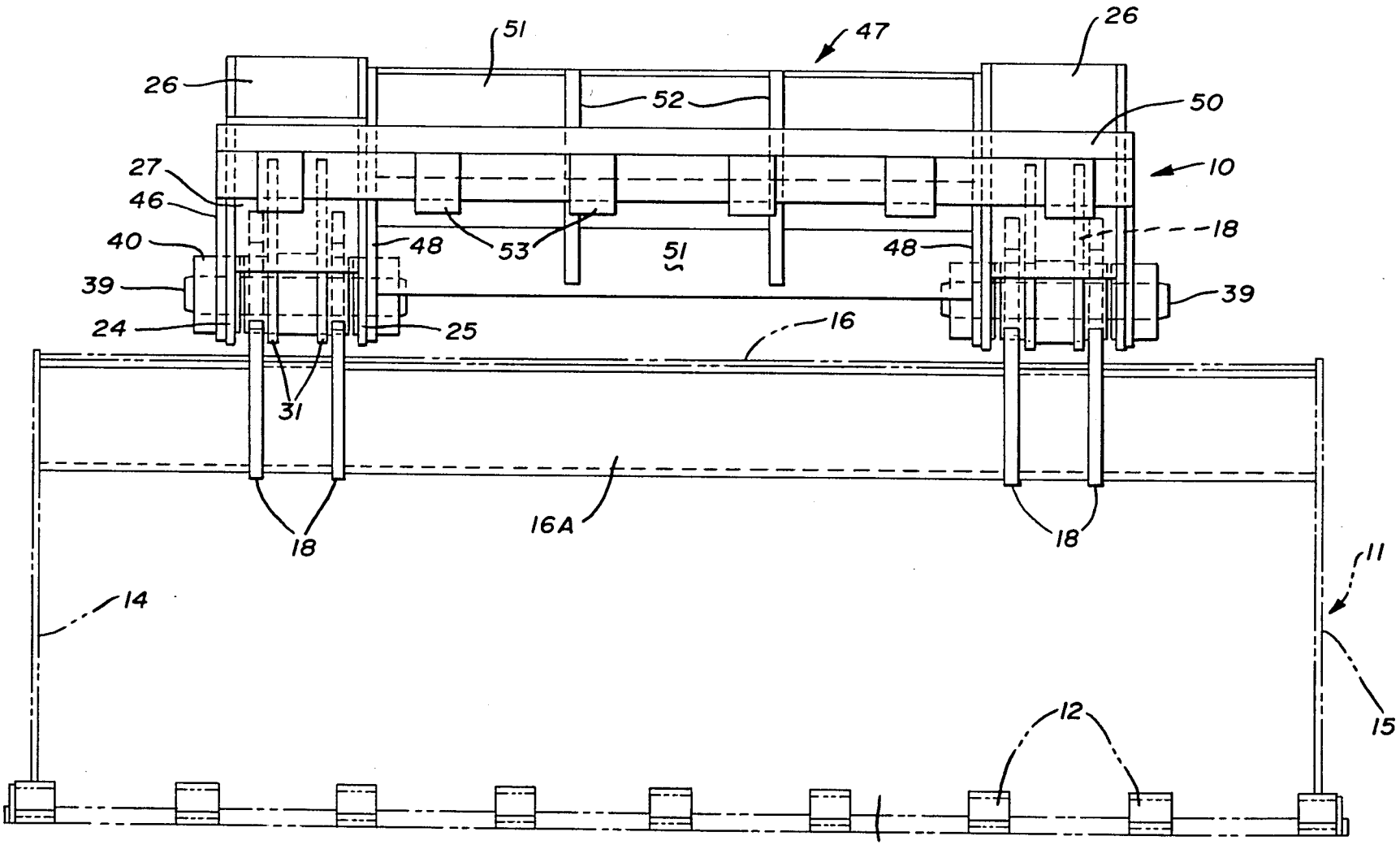
FIG. 2 is a front plan view of the bucket attachment in raised position.
Figure 3:
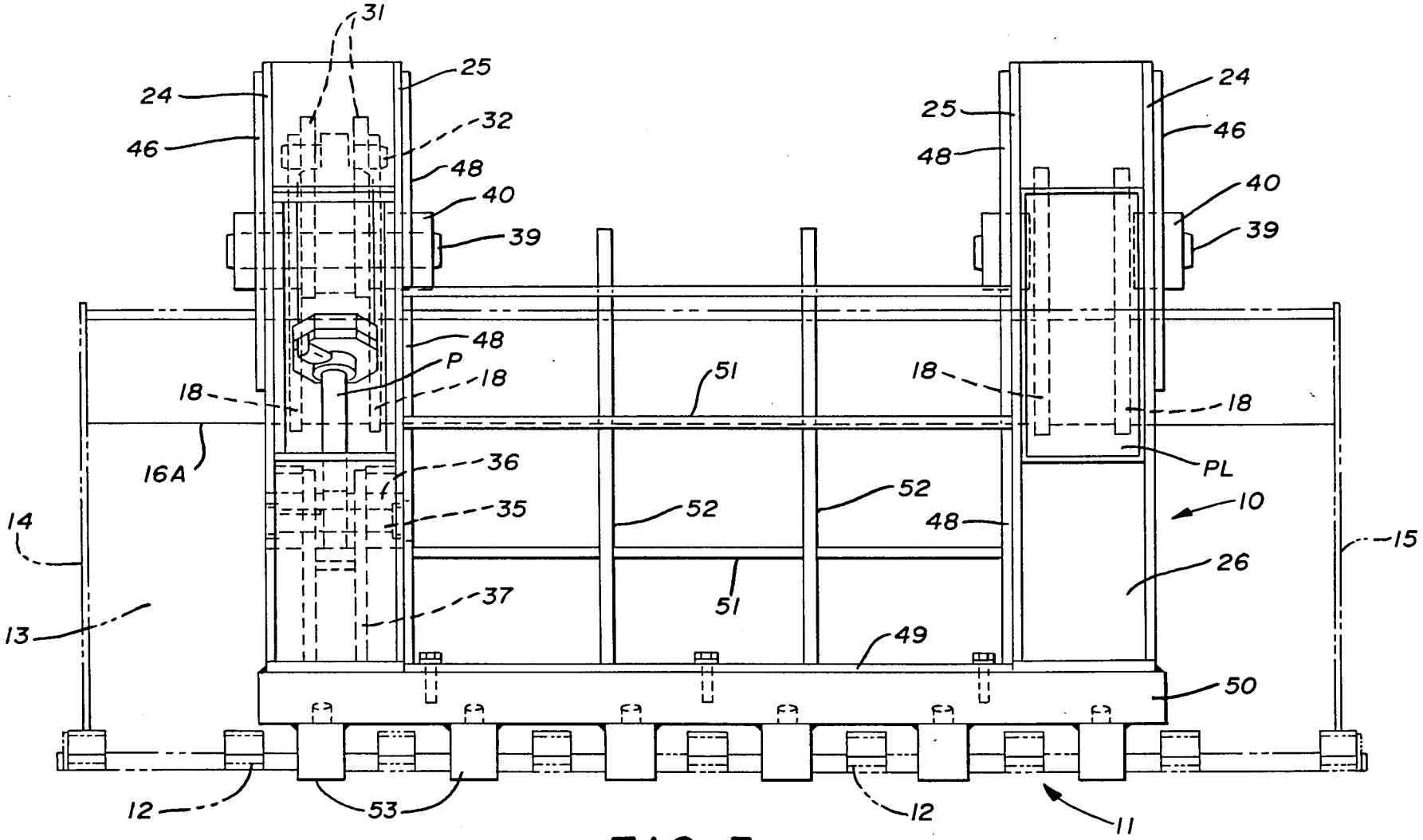
FIG. 3 is a front plan view of the bucket attachment in closed position.

A demolition bucket attachment 10 can be seen in FIGS. 1, 2, 3, and 5 of the drawings positioned on a loading bucket 11 which has a plurality of spaced ground engageable teeth 12 positioned along its lower portion. A body plate 13 extends rearwardly from the teeth 12 and upwardly in a generally U-shaped configuration and has oppositely disposed end panels 14 and 15 secured thereon forming the loading bucket 11. Elongated, cross-sectionally V-shaped reinforcing members 16 and 16A extended along the opposite sides of the body plate 13 adjacent its upper end and form a cross sectional square beam.

A pair of spaced apertured vertical mounting brackets 17 extend outwardly from the rear side of the body plate 13 to provide attachment points for a bulldozer or other hydraulically equipped construction equipment (not shown) as is common in the art. The bucket attachment 10 is detachably mounted on the body plate 13 of the loading bucket 11 by two pairs of spaced parallel upstanding plates 18 each of which is welded to said reinforcing members 16 and 16A which extend through an opening 60 in each plate 18, best seen in FIGS. 1, 2, and 5 of the drawings. The upstanding plates 18 have aligned notches 19 and aligned apertures 20. It will be evident that the pairs of upstanding plates 18 can be positioned anywhere along the reinforcing members 16 and 16A depending on the relative spacing required for different size loading buckets 11 and different size demolition bucket attachments 10.

The demolition bucket attachment 10 comprises a pair of horizontally spaced jaws 21, each comprised of a pair of spaced tapered arms 24 and 25 interconnected by upper and lower plates 26 and 27 continuously secured to one another along portions of their abutting edges. An access panel PL is removably positioned in the upper portion of each jaw 21 allowing for removal of the same for access to the interior of the respective jaw 21. One end of each of the jaws 21 is larger at its point of pivotal attachment to the loading bucket 11 and tapers downwardly towards it opposite free end.

Figure 4:
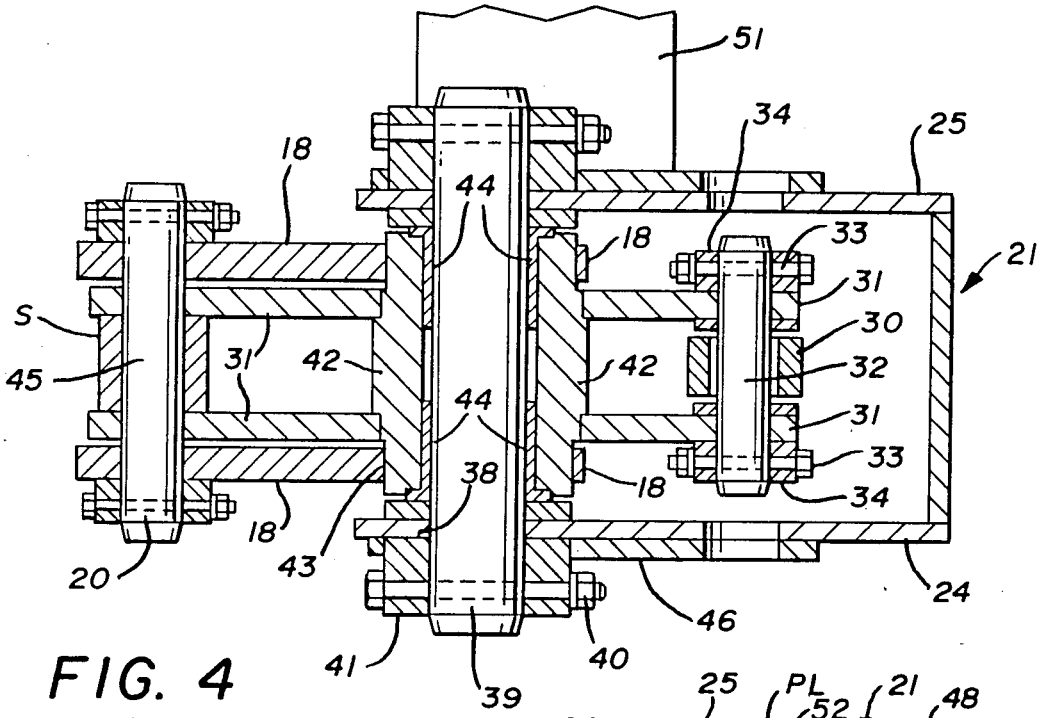
FIG. 4 is an enlarged cross-sectional of a portion of the bucket attachment on lines 4—4 of FIG. 1.
Figure 5:
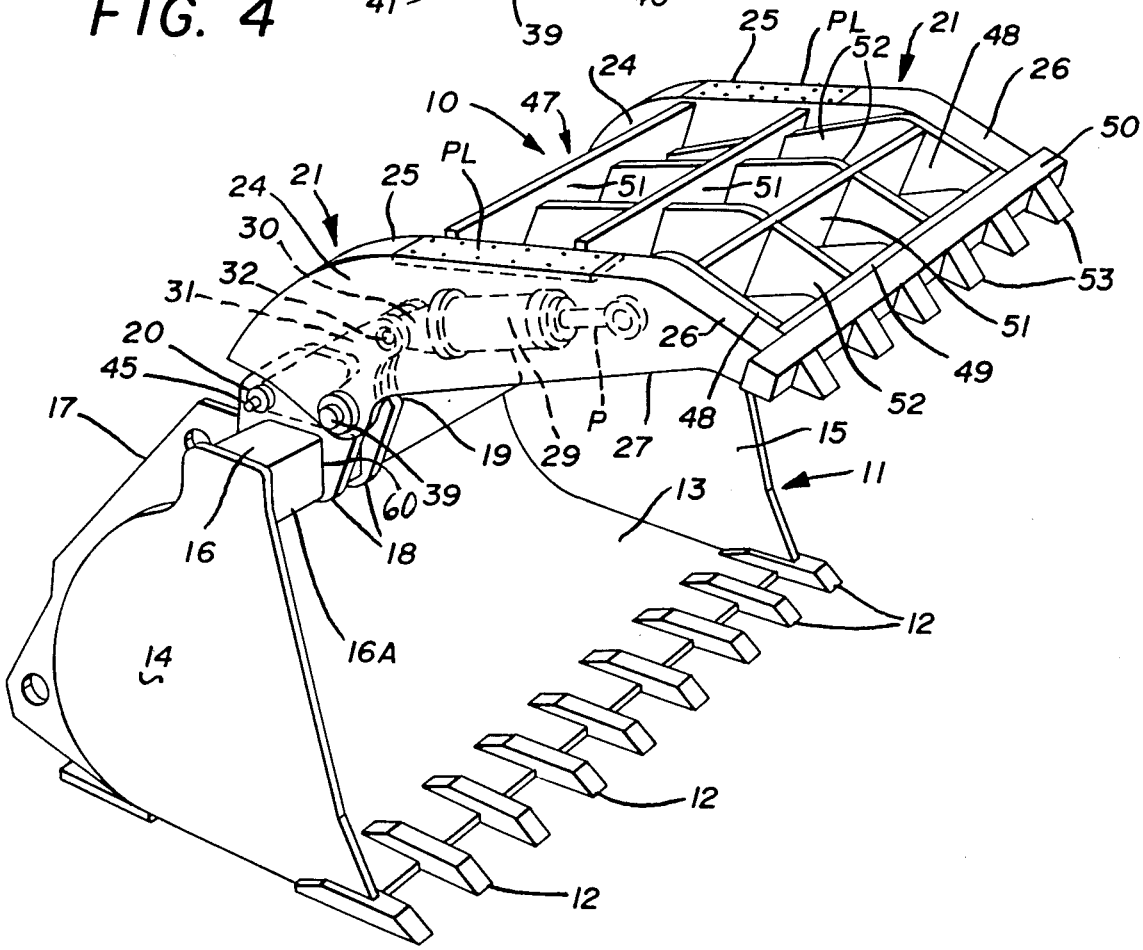
FIG. 5 is a perspective view of the bucket attachment on a bucket in raised position.

A hydraulic piston on cylinder assembly 29 with associated hydraulic supply lines SL has a mounting boss 30 and is positioned within each one of the jaws 21 between a pair of apertured spaced parallel brackets 31 by a fixed pivot pin 32 (see FIGS. 1, 3, and 5) which is retained between the brackets 31 by bolts 33 in apertured circular bosses 34 on the pivot pin 32 (see FIG. 4). A piston P of the piston and cylinder assembly 29 is pivotally secured to the jaw 21 by a fixed pivot pin 35 which is keyed within aligned bores in spaced support blocks 36 as best seen in FIG. 6 of the drawings. The support blocks 36 are positioned transversely between the arms 24 and 25 with a pair of spaced parallel apertured support plates 37 extending longitudinally within the jaw 21 providing a reinforcing load bearing structure within the lower portion of the jaw 21. The arms 24 and 25 are apertured at 38 (see FIG. 4) to receive a fixed pivot pin 39 secured to the arms 25 by bolts 40 and apertured bosses 41 that are affixed to arms 24 and 25 as by welding. Still referring to FIG. 4, a tubular fitting 42 having an outer stepped surface 43 is positioned through and secured to the parallel brackets 31 through which the fixed pivot pin 39 extends on spaced bushings 44. The pivot pins 39 and associated brackets 31 of each jaw are pivotally positioned in the notches 19 in the spaced parallel upstanding plates 18 and aligned so that a fixed pin 45 extends through said apertured plates 18 and brackets 31, as best seen in FIGS. 1, 4, and 5 of the drawings. It will be understood that each of the jaws 21 has a piston and cylinder assembly 29 therein.

Reinforcing apertured plates 46 are secured to outer surfaces of each of the arms 24 of the jaws 21. The horizontally spaced jaws 21 are connected by an open frame work 47 formed of jaw engagement plates 48, a front end plate 49 which abuts a reinforcing beam 50 that interconnects the spaced jaws 21 and several right angularly crossed elongated plate members 51 and 52. The plate members 51 extend transversely between the jaw engagement plates 48 on the jaws 21 and the intersecting cross plates 52 extend rearwardly to the front end plate 49. The transverse plates 51 are aligned in angularly offset relation with the jaws 21 providing the operator a clear view of the bucket and work. The plate members 47 also act as a grizzly for limited sorting of material in the bucket as it is moved which is advantageous when additional processing of the material is required.

A plurality of replaceable jaw teeth 53 are secured in spaced aligned relation to said reinforcing beam 50 so as to be in staggered relation to said teeth 12 when the jaws 21 are in closed position shown in broken lines in FIG. 1 of the drawings.

In use, the self-contained demolition bucket attachment 10 can be easily mounted on a loading bucket 11 that has been modified by the addition of the two pairs of spaced parallel upstanding plates 18 positioned thereon as hereinbefore described. The tubular fittings 42 on the fixed pivot pins 39 in the ends of the respective jaws 21 are positioned in the notches 19 in upstanding plates 18. The apertures in the brackets 31 and upstanding plates 18 are aligned for insertion of the pins 45 effectively securing the demolition bucket attachment 10 to the loading bucket 11 converting same into a true demolition bucket with movable bucket opposing jaws hydraulically operated by the hydraulic piston and cylinder assemblies 29 within each of the jaws 21. The loading bucket 11 is attached to a bulldozer or other hydraulically equipped self-propelled equipment by the bucket mounting brackets 17 in the usual manner with the hydraulic supply lines SL extending from the piston and cylinder assemblies of the attachment to the hydraulic system of the construction equipment.

It will thus be seen that a new and novel demolition bucket attachment has been illustrated and described and it will be apparent to those skilled in the art that various changes and modifications may be made therein without departing from the spirit of the invention. therefore I claim:

1. Apparatus for attachment to a loading bucket of a construction vehicle for conversion thereof to a demolition device said loading bucket having an elongated body plate cross sectionally curved intermediate its ends and of a known length and having an upper portion defining a horizontal upper edge and having panels on its opposite ends, said apparatus comprising: a pair of oppositely disposed longitudinally extending cross sectionally V-shaped reinforcing members position on the opposite sides of said upper portion at said upper edge thereof so that said upper portion extends diagonally therebetween, at least a pair of upstanding apertured plates having first openings inwardly of one end thereof engaged on the oppositely disposed V-shaped reinforcing members inwardly of said panels of said bucket, a demolition bucket attachment having pivot means thereon for registry with curved notches in said upstanding apertured plates above said openings, said demolition bucket attachment having a pair of horizontally spaced jaws and a structural web positioned therebetween and secured thereto, said jaws and structural web of said demolition attachment being of a lesser width than said known length of said body plate of said bucket so that its opposite ends are spaced inwardly of said end panels, means positioned in said jaws and connected thereto and to said upstanding apertured plates for moving said jaws and structural web toward and away from said body plate of said bucket.

2. The apparatus of claim 1 wherein said oppositely disposed cross sectionally V-shaped reinforcing members positioned on opposite sides of said upper portion of said body plate form a cross sectionally substantially square longitudinally extending hollow shape registrable in said openings inwardly of the ends of said upstanding plates whereby said upstanding apertured plates engaged the surfaces of said reinforcing members.

3. The apparatus of claim 1 wherein said structural web between said jaws consists of a reinforcing beam between the free ends of said jaws and a plurality of right angularly crossed and connected elongated plates, some of which extend between said jaws and some of which extend rearwardly from said reinforcing beam and all of which are positioned on edge when said structural web and jaws are in various positions whereby an operator can be see through said structural web.

4. The apparatus of claim 1 wherein said pivot means on said demolition bucket attachment consists of pairs of pivot pins on said jaws, one pin of each pair engaging a second opening in said upstanding plates and the other pin of each pair registering with said curved notches in said upstanding plates whereby removal of said pins from said openings disengages said attachment from said bucket.

5. The apparatus of claim 1 wherein said pivot means on said demolition bucket attachment consists of pairs of pivot pins in said jaws spaced with respect to one another and positioned longitudinally of said jaws, one pin of each pair engaging a second opening in said upstanding plates and the other pin of each pair registering with said curved notches in said upstanding plates whereby removal of said pins from said openings disengages said attachment from said bucket.

* * * * *